US009147928B2

(12) United States Patent
Kim et al.

(10) Patent No.: US 9,147,928 B2
(45) Date of Patent: Sep. 29, 2015

(54) BATTERY ASSEMBLY

(71) Applicants: JungMin Kim, Suwon (KR); Jinwook Seo, Suwon (KR); Junghoon Chae, Suwon (KR)

(72) Inventors: JungMin Kim, Suwon (KR); Jinwook Seo, Suwon (KR); Junghoon Chae, Suwon (KR)

(73) Assignees: AAC ACOUSTIC TECHNOLOGIES (SHENZHEN) CO., LTD., Shenzhen (CN); AAC ACOUSTIC TECHNOLOGIES (CHANGZHOU) CO., LTD., Changzhou (CN)

( * ) Notice: Subject to any disclaimer, the term of this patent is extended or adjusted under 35 U.S.C. 154(b) by 340 days.

(21) Appl. No.: 13/732,425

(22) Filed: Jan. 1, 2013

(65) Prior Publication Data

US 2013/0169492 A1 Jul. 4, 2013

(30) Foreign Application Priority Data

Jan. 4, 2012 (CN) ..... 2012 1 0000736

(51) Int. Cl.

| | |
|---|---|
| ***H01Q 1/24*** | (2006.01) |
| ***H01Q 1/44*** | (2006.01) |
| ***H01Q 7/00*** | (2006.01) |

(52) U.S. Cl.

CPC ..... *H01Q 1/242* (2013.01); *H01Q 1/243* (2013.01); *H01Q 1/44* (2013.01); *H01Q 7/00* (2013.01)

(58) Field of Classification Search

CPC ..... H01Q 1/242; H01Q 1/243; H01Q 7/00; H01Q 1/44

USPC ..... 343/720, 702, 741, 866

See application file for complete search history.

(56) References Cited

U.S. PATENT DOCUMENTS

| | | | | |
|---|---|---|---|---|
| 2011/0227799 | A1* | 9/2011 | Hashimoto | 343/702 |
| 2012/0162028 | A1* | 6/2012 | Kubo et al. | 343/702 |
| 2014/0217183 | A1* | 8/2014 | Yosui et al. | 235/492 |
| 2014/0320354 | A1* | 10/2014 | Sugita et al. | 343/702 |

FOREIGN PATENT DOCUMENTS

| | | | |
|---|---|---|---|
| JP | 2004227046 | * | 8/2004 |

* cited by examiner

*Primary Examiner* — Hoanganh Le

(74) *Attorney, Agent, or Firm* — Anova Law Group, PLLC

(57) ABSTRACT

Disclosed is a battery assembly. The battery assembly includes a battery and an antenna attached to the battery. The antenna has a loop-shaped part having a portion attached to a top surface of the battery, and a portion received in the battery. The antenna further includes a pair of output ends attached to a side of the battery, the side being perpendicular to the top surface.

9 Claims, 6 Drawing Sheets

BATTERY ASSEMBLY

FIELD OF THE INVENTION

The present invention generally relates to the field of batteries, and more particularly to a battery assembly with a communication antenna used in a mobile communication device.

DESCRIPTION OF RELATED ART

In order to reduce the size of a mobile phone, the communication antenna, such as a coil, is configured to be positioned with the battery used therein. A battery assembly related to the present disclosure includes a battery and a loop-shaped antenna attached to an outer surface of the battery. The loop-shaped antenna is wound by a conductive coil. The antenna includes a first terminal, a loop extending from the first terminal, and a second terminal extending from the loop. With the increase of the turn number of the loop, the distance between the first and second terminals is accordingly increased, which makes it more difficult to solder the terminals to exterior circuits.

Therefore, an improved battery assembly is desired to solve the problem mentioned above.

Figure 1:
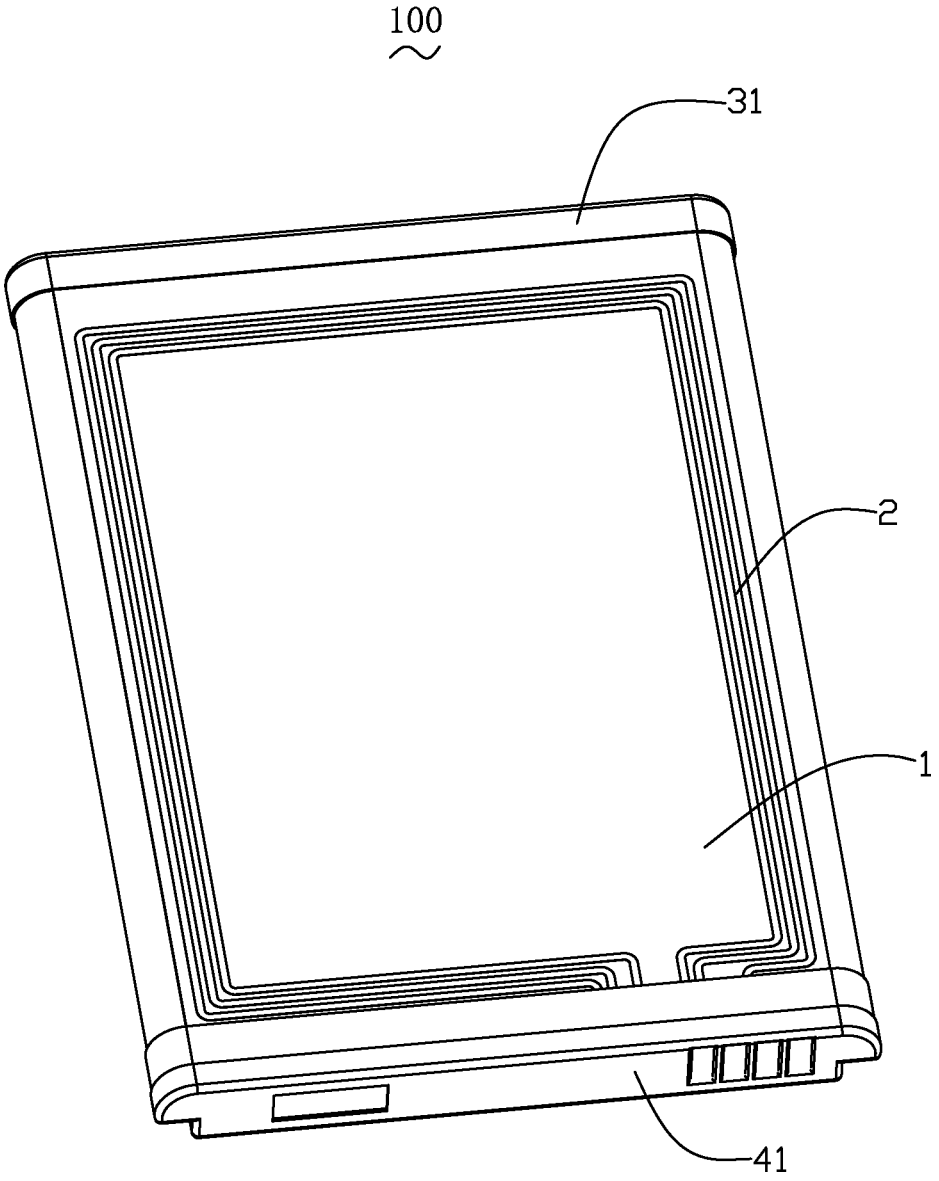
FIG. 1 is a schematic isometric view of a battery assembly in accordance with an exemplary embodiment of the present invention.

Many aspects of the embodiment can be better understood with reference to the drawings mentioned above. The components in the drawings are not necessarily drawn to scale, the emphasis instead being placed upon clearly illustrating the principles of the present disclosure. Moreover, in the drawings, like reference numerals designate corresponding parts throughout the several views.

DETAILED DESCRIPTION OF THE EXEMPLARY EMBODIMENT

An exemplary embodiment of the present disclosure will be described in detail as follows.

Figure 2:
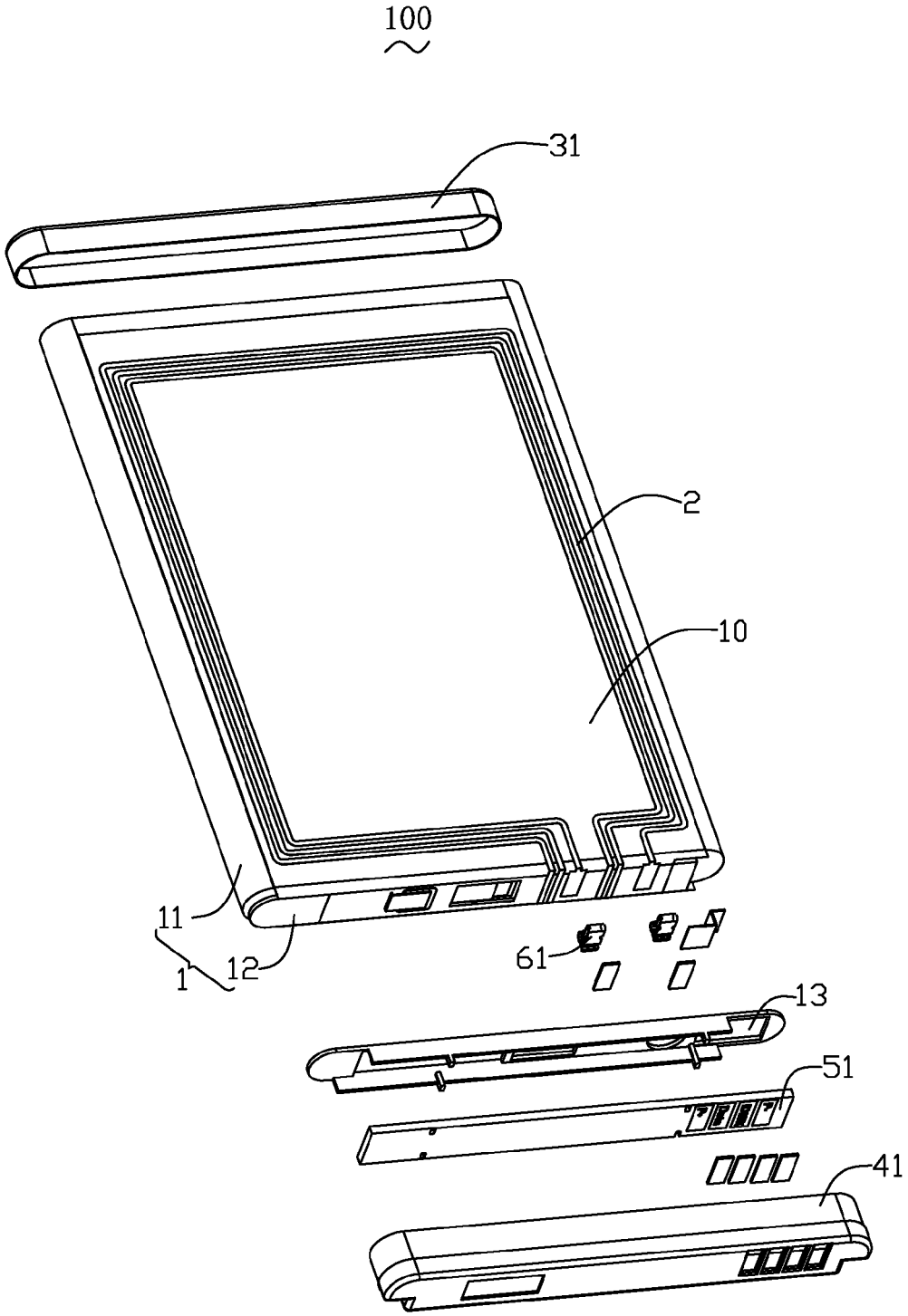
FIG. 2 is an exploded view of the battery assembly in FIG. 1.
Figure 3:
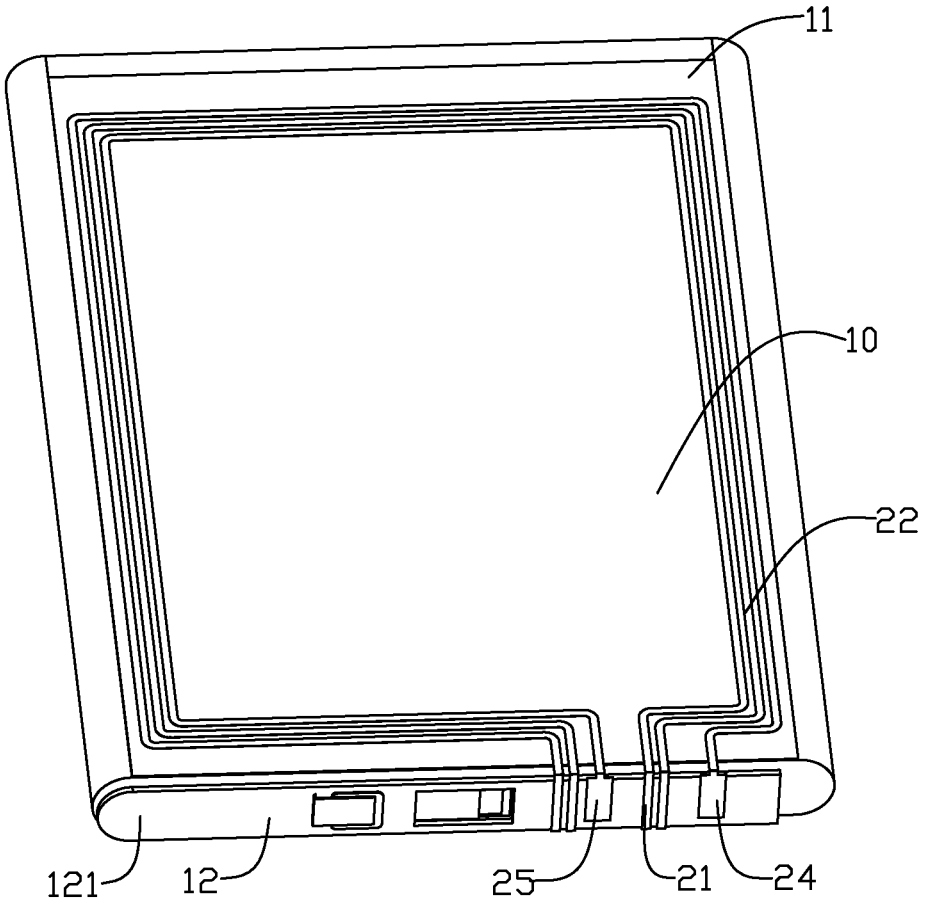
FIG. 3 is an assembled view of a battery and a loop-shaped antenna of the battery assembly of the present disclosure.
Figure 4:
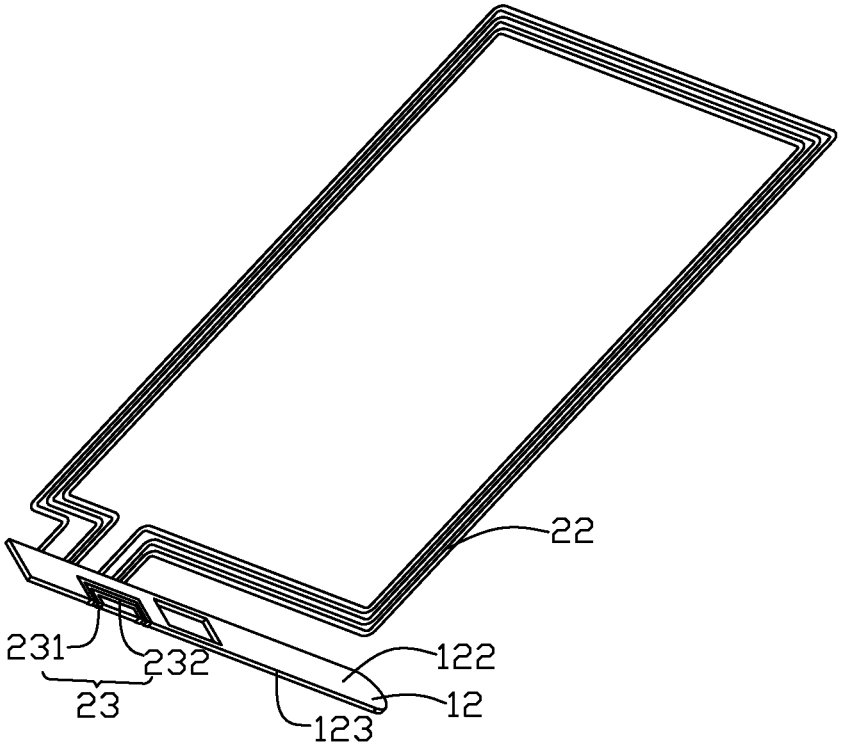
FIG. 4 is an assembled view of a connecting member and the loop-shaped antenna of the battery assembly of the present disclosure.
Figure 5:
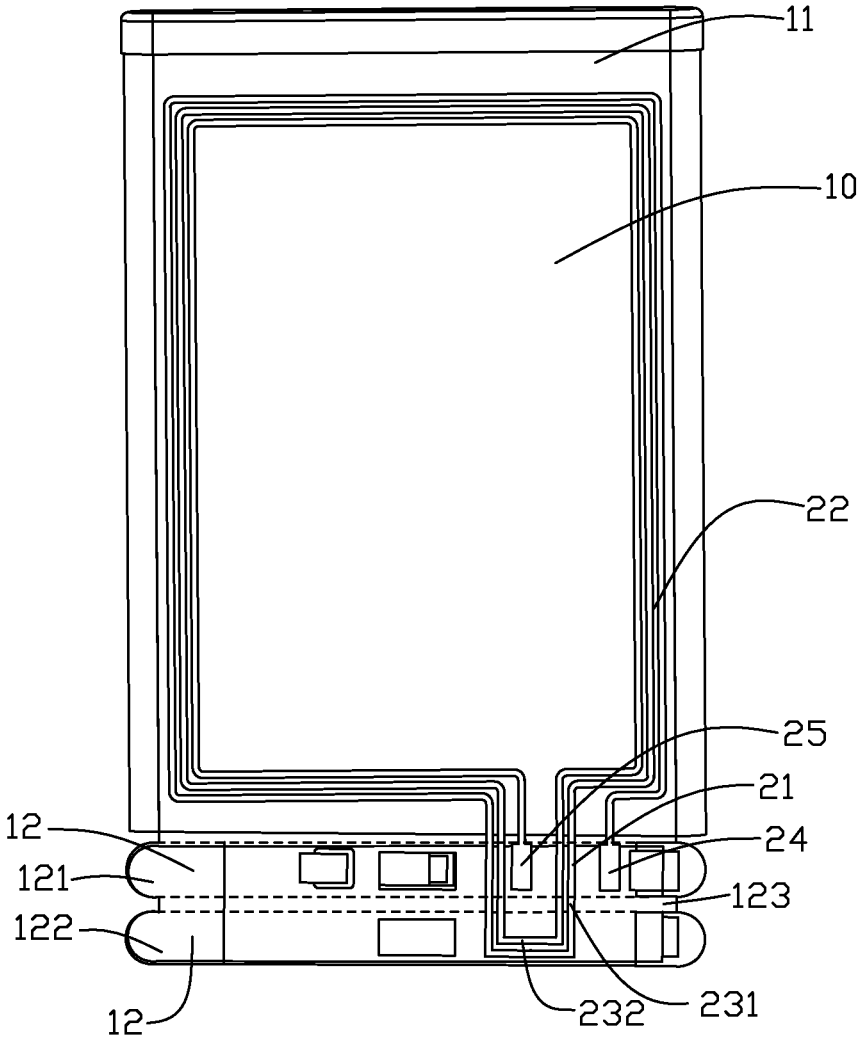
FIG. 5 is an expanded view of the loop-shaped antenna ready to be assembled with the battery.
Figure 6:
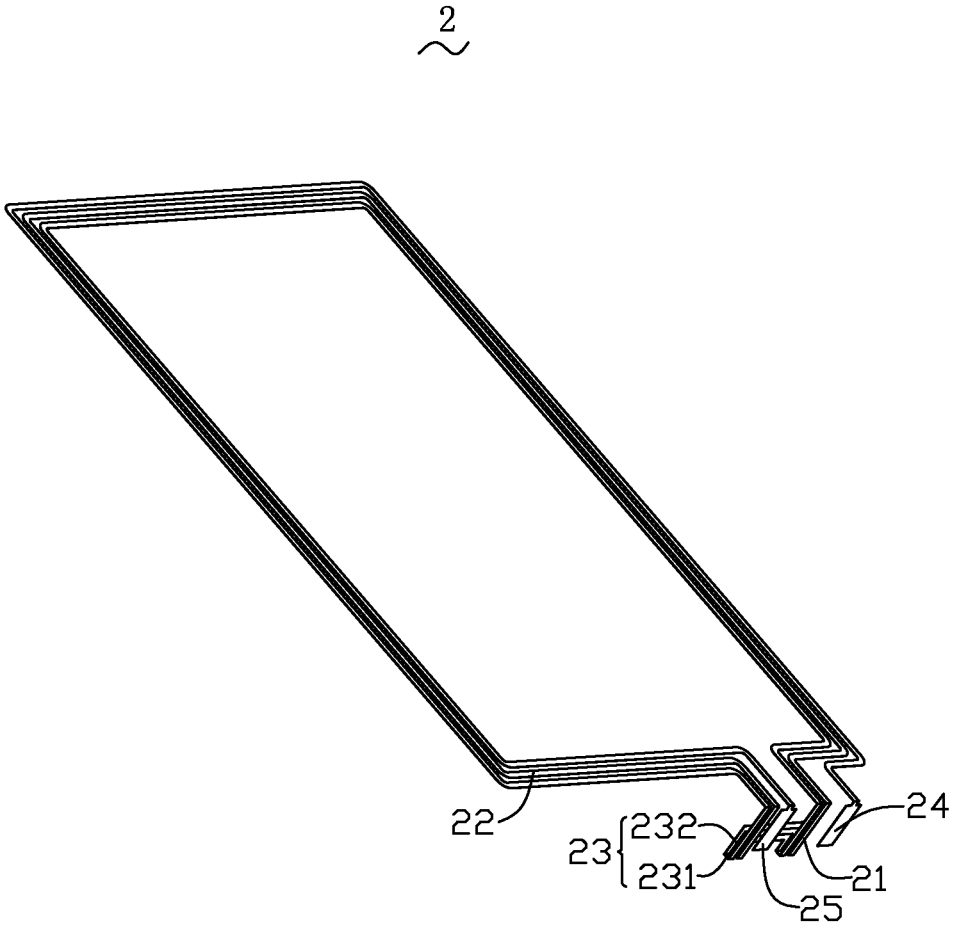
FIG. 6 is an isometric view of the loop-shaped antenna of the present disclosure.

Referring to FIGS. 1 and 2, a battery assembly 100 in accordance with an exemplary embodiment of the present disclosure includes a battery 1, an auxiliary member connecting with the battery 1, and a loop-shaped antenna 2 attached with the battery 1.

The battery 1 includes a core 11 and a connecting member 12 located on one side of the core 11. In this embodiment, the connecting member 12 is a double-side adhesive plate, and the battery 1 further includes a frame 13 located on one side of the connecting member 12.

The auxiliary member includes a circuit board 51 located on one side of the connecting member 12, terminals 61, a front cover 41 enclosing a front end of the core, and a back cover 31 located on the other side of the connecting member 12 for enclosing a back end of the core. The loop-shaped antenna 2 is wound by metallic coils and attached on a surface of the core 11. The antenna 2 may be used for near field communication (NFC), Bluetooth, or other communication function.

Referring to FIGS. 3-6, the core 11 includes a top surface 10 for carrying the loop-shaped antenna 2. The connecting member 12 includes a front surface 121 perpendicular to the top surface 10, a back surface 122 opposed to the front surface 121, and a side surface 123 connecting the front and back surfaces 121, 123 and parallel to the top surface 10 of the core.

The loop-shaped antenna 2 includes a first output end 24, a loop extending from the first output end 24, and a second output end 25 extending from the loop. The first output end 24 and the second output end 25 are both located on the front surface 121 of the connecting member 12 for enabling the first and second output ends to be electrically connected to an external circuit. The loop includes a first section 21, a second section 22, and a third section 23.

The first section 21 is a section located on the front surface 121 of the connecting member 12, the second section 22 is a section extending from the first section and located on the top surface 10 of the core 11, and the third section 23 is a section extending and bent from the first section 21 for being located on the back surface 122 of the connecting member 12. The third section 23 includes a connecting portion 231 attached to the side surface 123 of the connecting member 12, and a fastening portion 232 extending and bent from the connecting portion 231. The fastening portion 232 is located on the back surface 122 of the connecting member 12.

Another word, the third section 23 has a part thereof located on the side surface 123 of the connecting member 12, and another part thereof located on the back surface 122 of the connecting member 12. The part of the third section 23 located on the back surface 122 is perpendicular to the fastening portion 232. The terminals 61 are located between the connecting member 12 and the frame 13, and are electrically connected to the first and second output ends 24, 25 of the antenna 2. The circuit board 51 is located between the frame 31 and the front cover 41.

While assembled together, the second section 22 of the loop is attached on the top surface 10 of the core 11 of the battery 1, the first section 21 is located on the front surface 121 of the connecting member 12, and the third section 23 is located between the back surface 122 of the connecting member 12 and the core 11, by which the antenna 2 is fixed with the battery 1 firmly. The first and second output ends 24, 25 are also located on the front surface 121 of the connecting member 12 for electrically connecting to the external circuit.

While the present disclosure has been described with reference to the specific embodiment, the description of the disclosure is illustrative and is not to be construed as limiting the disclosure. Various of modifications to the present disclosure can be made to the exemplary embodiment by those skilled in the art without departing from the true spirit and scope of the disclosure as defined by the appended claims.

What is claimed is:

1. A battery assembly, comprising:

a battery including a core, a connecting member assembled with the core, a front cover enclosing a front end of the core, and a back cover enclosing a back end of the core, the connecting member comprising a front surface, a back surface opposed to the front surface and attached to core, and a side surface connecting the front and back surfaces;

an antenna assembled with the core, the antenna comprising a first output end attached to the front surface of the connecting member, a second output end attached to the front surface of the connecting member, and a loop extending from the first and second output ends; wherein the loop includes a first section located on the front surface of the connecting member, a second section attached to a top surface of the core, and a third section located between the back surface of the connecting member and the core.

2. The battery assembly as described in claim 1, wherein the third section of the loop comprises a connecting portion located on the side surface of the connecting member, and a fastening portion located on the back surface of the connecting member.

3. The battery assembly as described in claim 2, wherein the connecting portion located on the side surface of the connecting member is perpendicular to the fastening portion located on the back surface of the connecting member.

4. The battery assembly as described in claim 1 further comprising a frame attached to the front surface of the connecting member.

5. The battery assembly as described in claim 4 further comprising a circuit board located between the frame and the front cover.

6. A battery assembly, comprising:

a battery including a core and a connecting member attached to the core;

an antenna including a first part attached to a top surface of the core, a second part located on a front surface of the connecting member, a third part located between the connecting member and the core, and a pair of ends disposed on the front surface of the connecting member.

7. The battery assembly as described in claim 6 further comprising a front cover attached to the front surface of the connecting member, and a back cover enclosing a back end of the core.

8. The battery assembly as described in claim 7 further comprising a frame and a circuit board both located between the front surface of the connecting member and the front cover.

9. The battery assembly as described in claim 6 further comprising a pair of terminals electrically connected to the pair of ends of the antenna.

* * * * *